US005562285A

United States Patent [19]

Anfinsen et al.

[11] Patent Number: 5,562,285

[45] Date of Patent: Oct. 8, 1996

[54] DISTANCE MEASURING SYSTEM FOR A DRIVEN GOLF BALL

[75] Inventors: Leonard F. Anfinsen, Long Valley, N.J.; Burton B. Lieberman, New York, N.Y.

[73] Assignee: United States Golf Association, Far Hills, N.J.

[21] Appl. No.: 500,584

[22] Filed: Jul. 11, 1995

[51] Int. Cl.[6] ..... A63B 69/36

[52] U.S. Cl. ..... 473/155; 473/192

[58] Field of Search ..... 273/32 R, 35 R, 273/181 G, 181 R, 183.1, 184 R, 186.1, 186.3; 434/252

[56] References Cited

U.S. PATENT DOCUMENTS

| | | | |
|---|---|---|---|
| 4,801,880 | 1/1989 | Koike | 273/29 A |
| 4,898,388 | 2/1990 | Beard, III et al. | 273/181 R |
| 5,062,641 | 11/1991 | Poillon et al. | 273/181 R |
| 5,447,315 | 9/1995 | Perkins | 273/181 R |
| 5,478,077 | 12/1995 | Miyahara | 273/185 R |

*Primary Examiner*—Jessica J. Harrison
*Assistant Examiner*—James Schaaf
*Attorney, Agent, or Firm*—Francis C. Hand

[57] ABSTRACT

The system for determining the carry and/or lateral deviation and/or flight time of a driven golf ball uses a grid of geophones to sense the time of impact of a driven golf ball. The geophones are buried in the ground so that the impact is sensed via sound waves travelling through the ground. A computer receives a signal from each sensor indicating an impact and determines the time at which the impact was sensed by each sensor and screens out all but the six shortest times of impact. This information is then used to mathematically calculate the point of impact within a square of geophones corresponding to the recorded times. A plot of the flight path of the golf ball can be displayed on a display monitor based upon the carry and the flight time. The calculated flight time and carry are compared with a known standard to determine conformance with the standard.

14 Claims, 3 Drawing Sheets

DISTANCE MEASURING SYSTEM FOR A DRIVEN GOLF BALL

Figure 1:
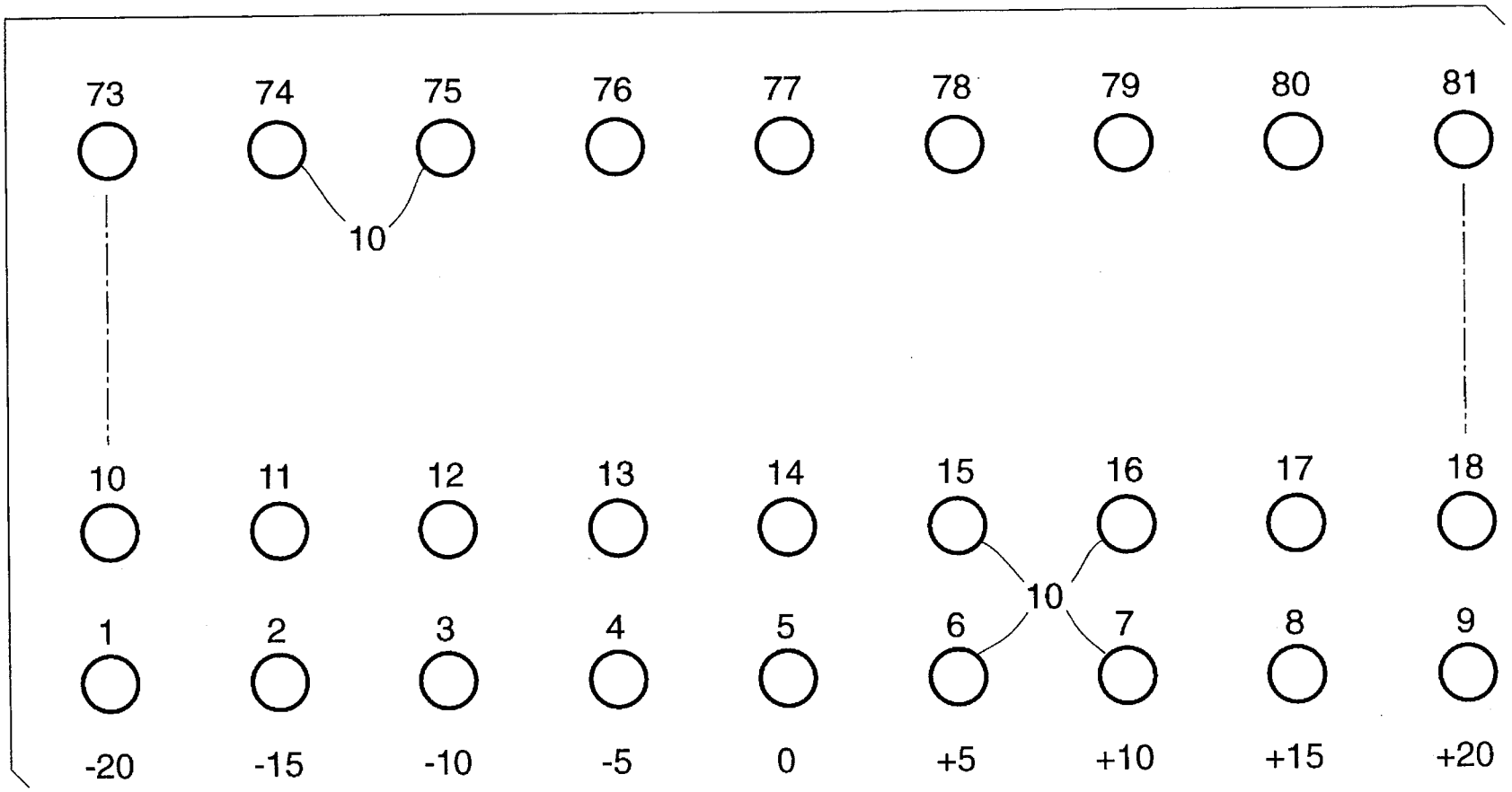

This invention relates to a system for measuring the carry of a golf ball. More particularly, this invention relates to a system for determining the carry, lateral deviation and flight time of a driven golf ball.

As is known, various standards have been established for golf balls, such as weight, size, spherical symmetry and the like. One particular standard is the "overall distance standard" which, in accordance with the Rules of the United States Golf Association, sets a standard for the average distance in carry and roll for a golf ball which is driven with standardized testing equipment.

In order to determine if a golf ball, or a series of golf balls, conforms with an established standard, various tests can be conducted on the balls. For example, in order to determine conformance with the overall distance standard, it has been known to drive a golf ball off a tee using a mechanical means which can be controlled so that each ball in a series of golf balls can be driven at the same speed under the same conditions. Typically, the mechanical means strokes each golf ball of a series of golf balls onto a driving range which has been provided with a marked grid of distances from the tee.

In the past, in order to obtain a measurement of the carry of the ball, a person has been stationed near the driving range to visually sight the point of impact of the driven golf ball within the grid and, in some cases, the point at which the ball comes to a stop to visually determine the roll of the ball. In this respect, the term "carry" defines the distance from the tee to the point of impact and the term "roll" defines the distance from the point of impact to the point at which movement of the ball ceases.

In addition to marking the point of impact, the observer may also use a stop watch to determine the flight time of the ball. Usually, the stop watch is activated in dependence on a visual sighting by the observer of the ball leaving the tee.

However, because the measurement of carry and the measurement of flight time are subjective in this type of visual-dependent technique, the measurements have not been precise. Furthermore, where a series of balls are being tested over a period of time, distractions and fatigue may impact on the accuracy of the measurements taken by an observer.

In order to overcome the problems associated with a visual observation of the distance travelled by a ball and/or the flight time, suggestions have been made to position microphones or the like in the driving range at predetermined points so as to pick up the sound of impact of a ball and to more accurately determine the carry and flight time of a ball. However, such a system picks up noise from the surrounding environment. Hence, the sound of impact may not be accurately recorded. Further, picking up a sound vibration through the air can be affected by other effects such as wind, humidity and the like which normally occur from time-to-time in the air.

U.S. Pat. Nos. 4,898,388; 5,029,866 and 5,393,064 describe systems in which a projectile impact location can be determined within a target area which is a generally elongate, generally rectangular, generally a horizontal surface area by triangulation. In addition, the system employs an array of vibration sensors which are distributed in the predetermined pattern and each of which generates an electrical sensor signal indicative of the sensing of vibration. An electrical processor is electrically connected with the sensors for receiving sensor signals generated thereby and for processing the information to determine the location of ball impact by a process of triangulation. The processor has an associated memory for storing a plurality of location signals and functions for compiling and comparing sets of location signals indicative of the impacts of a succession of projectiles.

Systems of the above type are limited not only in the type of sensor array which is employed but also in attempting to locate a point of impact by triangulation techniques.

Accordingly, it is an object of the invention to provide a reliable system for determining the carry, lateral deviation and flight time of a golf ball.

It is another object of the invention to be able to determine the hook or slice of a driven golf ball.

It is another object of the invention to reliably determine conformance of a golf ball with the "overall distance standard" of the United States Golf Association.

It is another object of the invention to provide a relatively simple system for determining the carry and/or lateral deviation and/or flight time of a driven golf ball.

Briefly, the invention provides a system for determining the carry and/or lateral deviation and/or flight time of a driven golf ball. This system includes a grid of sensors, each of which is buried at a predetermined point under a ground surface for sensing the impact of a golf ball on the ground surface via sound waves travelling through the ground. In addition, each sensor functions so as to emit a signal corresponding to the sensed impact.

A signal means is also provided for emitting a start signal or pulse indicative of the time at which a golf ball leaves a predetermined point, e.g. a golf tee. The signal means may be used with a mechanical means for stroking a golf ball from a predetermined point, for example, a tee, onto the ground surface within the grid of sensors.

Still further, the system includes a computer which is typically housed in an outdoor enclosure adjacent to the sensor grid as well as a plurality of circuit boards, each of which is connected by electrical wires or electronically to a respective sensor in the sensor grid. For example, each circuit board includes an amplifier to receive and amplify a signal from a sensor as well as a flip/flop circuit for receiving the amplified signal and flipping from an activate state to a reset dormant state in response to the signal.

In addition, the system includes a counter/timer for each circuit board for counting programmed frequency source pulses.

The system also has a means in the form of a timer which is programmed to emit a timing pulse to each flip/flop circuit with a preset time delay, for example, a time delay of five (5) seconds after receiving the start pulse from the signal means at the tee. This time delay would depend, for example, upon the expected flight time of the golf ball being tested. Typically, each counter/timer will keep a count of time from the instant that the timing pulse activates the associated flip/flop circuit until an impact is sensed.

When a ball hits the ground, each sensor in the immediate region of the impact senses the impact and generates a small voltage signal which is amplified by the associated amplifier and delivered to the associated flip/flop circuit to reset the flip/flop circuit. When a flip/flop circuit is reset, the associated counter/timer stops counting and retains the count in a hold register. Those counter/timers associated with the sensors which have not sensed the impact keep counting until reaching terminal count.

The computer is programmed so that each hold register of a counter/timer can be read and so that the "read" value of time can be stored in an array with a sensor identifier identifying the sensor which emitted the signal in response to the sensed impact. This array is then sorted to select the six shortest times. These times are then added to the base time, for example a five second base time, to give six raw flight times.

Still further, the system employs a solving means for receiving the raw flight time data. This solving means may be incorporated in the computer or may be incorporated in a second computer within the outdoor enclosure or at an indoor control console adjacent to the mechanical means for stroking a golf ball. In any case, the solving means receives the raw flight time data and mathematically calculates the actual distance a golf ball has been driven from the tee as well as a differential distance from a zero yard center line. In addition, a correct flight time is also calculated.

After the data is sent to the solving means, a software program within the first computer sends a reset pulse to all of the flip/flop circuits to make sure that all are reset to await the next impact of a ball within the sensor grid. The resetting of all of the flip/flop circuits is necessary because those sensors and associated amplifiers that do not sense the impact have flip/flop circuits which are not reset by a ball impact.

The solving means is able to determine the carry of the golf ball, i.e. the distance from the tee to the point of impact as well as the lateral deviation, in dependence on the locations of the sensors corresponding to the six shortest times of impact and the times of impact corresponding thereto.

Thus, using the six shortest time signals, the solving means first establishes a square (defined by four sensors) within which the ball has most likely impacted. In this respect, the square should most often be defined by the four sensors providing the shortest time periods. Thereafter, the solving means calculates the point of impact within this square knowing the distances between the four sensors defining the square and the times of impact for each sensor.

The solving means is also able to calculate the flight time of a ball knowing the point of impact, the time of impact sensed by the closest sensor, the distance between this latter sensor and the point of impact and the speed of sound through the ground between these points.

The system may also be provided with a program means for plotting and displaying a flight path of the golf ball based upon the calculated carry of the ball and the calculated flight time. This program means may also determine and display a lateral deviation of the flight of the golf ball from a straight line between the tee and the grid as a measure of the hook or slice of the ball.

Figure 2:
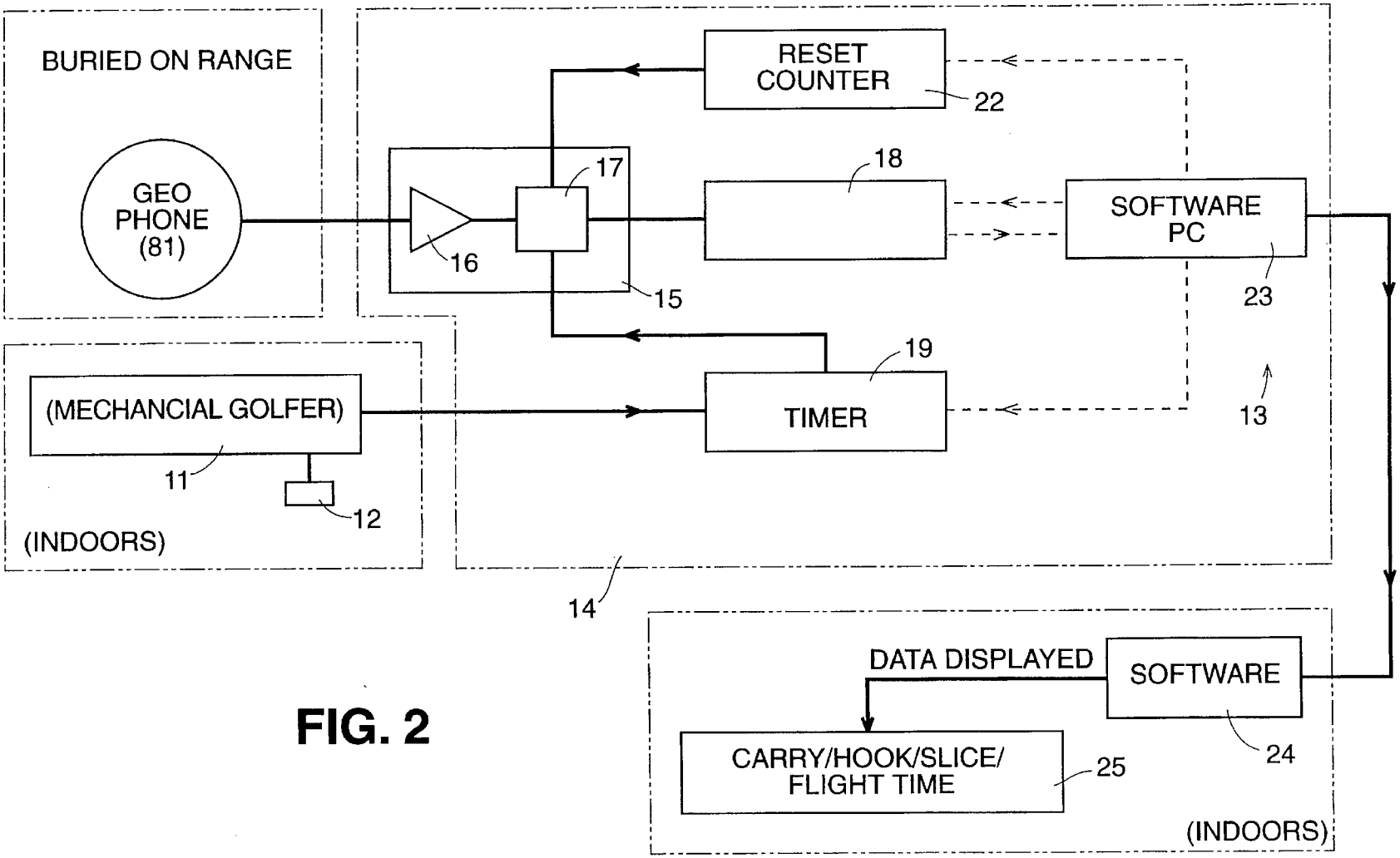
Figure 3:
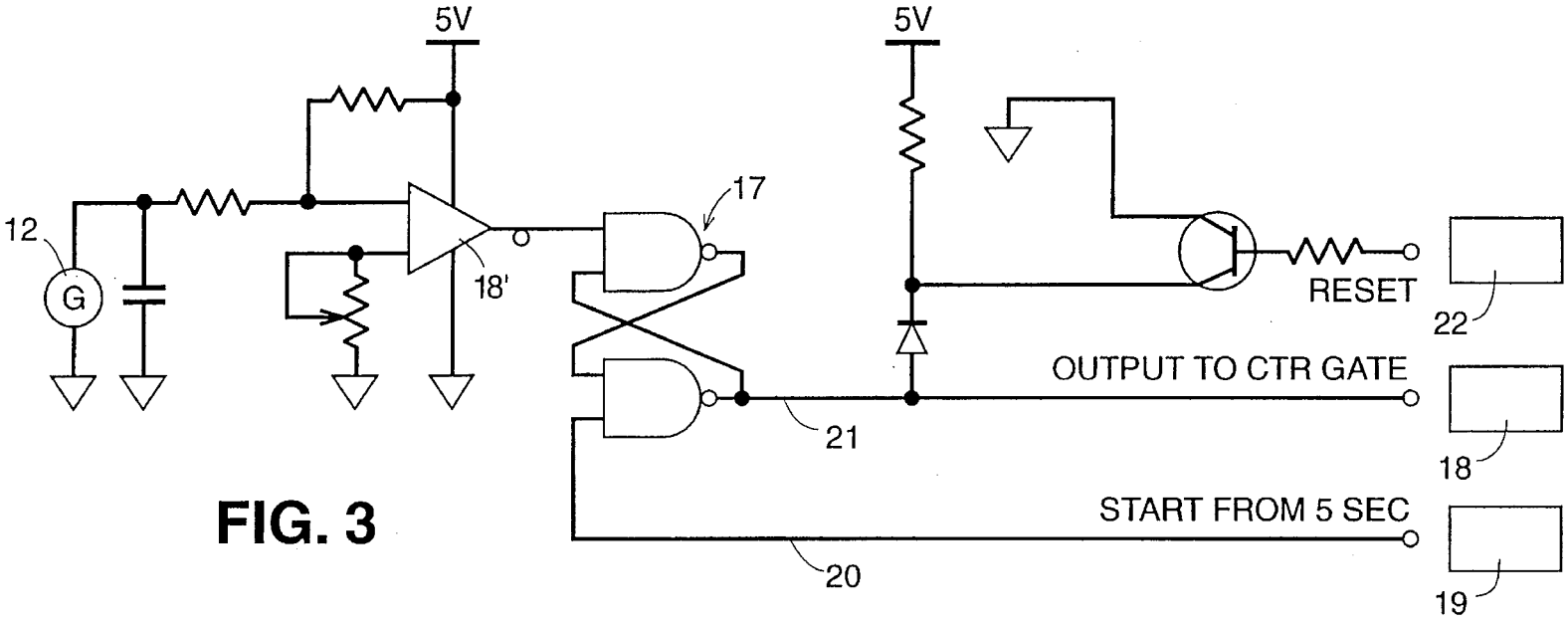
Figure 4:
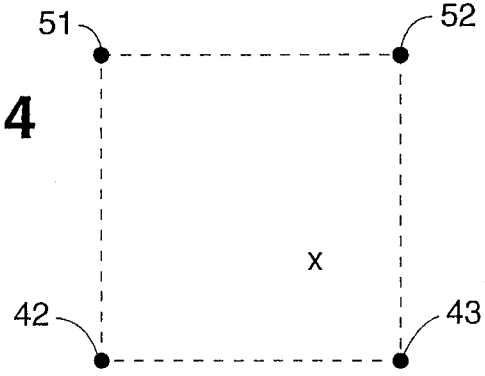

These and other objects and advantages of the invention will become more apparent from the following description taken in conjunction with the accompanying drawings wherein:

FIG. 1 schematically illustrates a sensor grid for a system constructed in accordance with the invention;

FIG. 2 schematically illustrates a system constructed in accordance with the invention;

FIG. 3 illustrates a schematic circuit for a sensor, a circuit board with an amplifier and flip/flop circuit and a reset counter employed in accordance with the invention; and FIG. 4 illustrates a graphic representation of a point of impact of a ball within a square of sensors.

Referring to FIG. 1, the system for determining the carry and/or flight time of a driven golf ball includes a grid of sensors 10 wherein each sensor 10 is buried at a predetermined point in a square grid, for example, in a nine by nine (9×9) grid with a spacing of five (5) yards between the sensors. For example, each sensor 10 is buried under the ground surface at a depth of approximately six inches for sensing the impact of a ball on the ground surface via sound waves travelling through the ground. In particular, each sensor 10 senses the impact of a golf ball on the ground surface.

Each sensor 10 may be constructed as a geophone, for example, a GS-40D Rotating Coil Geophone obtained from Geo Space Corporation, Houston, Tex. and carrying a designation "U.S. Pat. No. 3,119,978". In this respect, each sensor 10 functions so as to sense the sound of an impact of a ball on the ground through vibrations which are transmitted from the point of impact through the ground to the sensor 10 and to emit a corresponding signal.

Referring to FIG. 2, the system also includes a mechanical means 11 for stroking a golf ball from a predetermined point, such as a tee (not shown), onto the ground surface within the grid of sensors 10.

For example, the mechanical means 11 may be constructed in the manner of the so-called "Iron Byron" employed at the research facilities of the United States Golf Association, Far Hills, N.J. Such a mechanical means uses a golf club of given number, such as a number #1 Wood, in order to drive a golf ball from a tee. This mechanical means 11 is programmed so that each of a series of golf balls can be driven under the same impact conditions.

The system also includes a signal means 12 which is associated with the mechanical means 11 for emitting a start pulse indicative of a golf ball leaving the tee. This signal means 12 may be in the form of a laser timing arrangement wherein a laser beam is reflected back and forth across the path of the hosel of the golf club. As the hosel breaks the laser beam, a pulse is generated that advances a decade counter. Each break of the laser beam corresponds to two (2) inches allowing the club head speed to be accurately measured by timing the pulses generated by the decade counter. A final pulse of the decade counter is used as the output start signal indicative of the golf ball leaving the tee.

For example, the signal means 12 issues a final usable start pulse which is approximately ⅛ before impact of the club head on the ball. At this point, the club head is travelling at 109 miles per hour.

The system also employs a computer 13 which is housed in an outdoor enclosure 14 near to the sensor grid along with a plurality of circuit boards 15 (only one of which is shown for simplicity). Each circuit board 15 is connected with a respective sensor 10 to receive a signal therefrom corresponding to the sensed impact of a golf ball. Each circuit board 15 has an amplifier 16 to amplify the received signal and a flip/flop circuit 17 which reacts to the amplified signal by switching from an active state (on) to a reset dormant state (off).

The system also has a plurality of counter/timers 18 in the enclosure 14, each of which is connected with a respective flip/flop circuit 17 of a circuit board 15. Each counter/timer 18 (only one of which is shown) when activated via an associated flip/flop circuit 17 as explained below begins a counting sequence and when the flip/flop circuit 17 is subsequently switched off via an amplified signal from the amplifier 16 stops the counting sequence in order to establish a time of impact for a respective sensor.

By way of example, an AM951A System Timing Controller, available from Advanced Micro Devices of Sunnyvale, Calif., may be used. Such a controller has five independent 16-bit counters for counting, sequencing and timing applications. In the present case, each such controller is connected with five sensors 10. Four of such controllers may be incorporated in a computer plug-in board such as a PC-CTR-20 20-channel counter/timer interface available from Omega Engineering, Inc.

Each counter/timer 18 also has a hold register 18' to retain the counting sequence in response to reception to an amplified signal from a respective flip/flop circuit 17.

As shown in FIG. 2, the system has a means such as a counter/timer 19 connected to the signal means 12 in order to receive the start signal and to deliver an activating signal in response to all the flip/flop circuits 17. In particular, the timer 19 is connected to all of the flip/flop circuits 17 in order to deliver a time-delayed pulse to each flip/flop circuit 17 in order to switch the flip/flop circuit 17 from a dormant state (off) to an activated state (on) so as to deliver a signal to the associated counter/timer 18 to begin counting. The amount of the time delay is treated as a base time and can be adjusted from time-to-time.

For example, the timer 19 issues a 100MS pulse that is delivered by buffer amplifiers (not shown) to all of the 81 flip/flop circuits 17 associated with the 81 sensors 10 (geophones) via lines 20 (see FIG. 3). The action of each flip/flop circuit 17 now causes a gate signal lead 21 (see FIG. 3) of the associated counter/timer 18 to become active and to thereby enable the counter/timer 18 to start counting the programmed frequency source pulses.

Each counter/timer 18 of a AM9513A System Timing Controller is programmed as a Mode B Counter (i.e. a software triggered strobe with level gating).

The enclosure 14 also houses a digital input/output DIO Board 29 which is connected in parallel with the timer 19 relative to the signal means 12 in order to receive the start pulse indicative of a golf ball leaving the tee. The computer 13 repeatedly looks at the DIO Board 29 for an indication that a ball has been hit. When the ball has been hit, as indicated by the DIO Board 29, the computer 13 reads this and the program continues.

The computer 13 is programmed to access and read each hold register 18' and includes a store means provided as a data variable in the computer program for storing a value corresponding to a retained counting sequence as well as a corresponding sensor identifier in each hold register. Likewise, a sorting means is provided as a sub-routine within the computer program for sorting the stored values and selecting a preselected number of the shortest time values and corresponding sensor identifiers for addition to the base time as the recorded times of impact of a ball.

As illustrated in FIG. 2, the enclosure 14 houses a reset counter/timer 22 which is connected with all of the flip/flop circuits 17 so as to deliver a reset pulse to each at an appropriate time.

As indicated, the computer 13 is programmed via suitable software for programming the various components of the system to carry out the functions assigned thereto. For example, the software sets up and initializes all counter/timers 18, reads the DIO Board 29, reads the data from the hold registers of the counter/timers 18, stores the data, sorts the data and sends the data to a solving means, for example in the form of a sub-routine in the main program or a second computer 24 located within the enclosure 14 or another enclosure 23 near to the mechanical golfer 11 and signal means 12 and indoors.

The solving means serves to receive the recorded times of impact from the sorting means of the computer 13 in order to calculate the point of impact of the golf ball within the sensor grid in dependence on the recorded times of impact and the distances between the sensors. More particularly, the solving means determines the point of impact in dependence on the locations of the sensors corresponding to the six shortest times of impact.

The solving means may also be programmed to display various data on a screen 25. For example, the solving means 24 may illustrate data corresponding to the carry of a ball, the lateral deviation of the ball and the flight time of the ball.

The solving means is connected to the computer 13 by a suitable link, such as an RS 232 Link, however, if solving is carried out in the main computer 13, no such link is necessary.

The software for the computer 13 is, for example, written in BASIC, to control all of the counter/timers, each being programmed individually as to their function. The software also reads the data from the hold registers of the counter/timers, places the data in a variable and then sorts the data to determine the six shortest times. The software also controls the reset pulse. The software also contains subroutines necessary to compute the carry, lateral deviation and the corrected flight times. This data is then sent to the second computer which may be indoors via RS 232 link for incorporation into an overall distance testing program.

The system thus employs four basic means for determining the carry of a driven golf ball.

The first means is the interface between the mechanical golfer 11 and the sensor grid. This interface includes the signal means 12 for emitting a pulse indicative of a ball leaving the tee. In this regard, rather than using a laser timing arrangement, use may be made of a microphone which senses the ball being struck or some other electric means.

The second means of the system resides in the time delay timer 19. This timer 19 is found to be necessary in order to obtain a required resolution of the flight times to insure accurate results. This will include the counting hardware and the necessary software and interconnections to the third means which includes the flip/flop circuits 17 and the counter/timers 18.

Because each counter/timer 18 can usually count to no more than 65.536 seconds as programmed, the time base required to time a normal flight of 6 to 7 seconds would provide a measured time in a range of 6,000 to 7.000 seconds (for a timer range of from 0 to 65.535 seconds). By having a 5 second base timer, use can be made of a different time base because one needs to measure only 1 to 2 seconds and can then resolve to 0 to 6.5536 seconds on the counter/timer 18. Thus, the system is able to resolve the total flight time to four decimals rather than three decimals.

The third means of a system resides in the sensors 10, associated amplifiers 16, flip/flop circuits 17 and the counter/timers 18 that do the counting. This third means also includes the associated programming that sets up the counter/timers 18, reads the times stored in the various hold registers and stores and sorts the data for sending to the next means, i.e. the second computer 24 or a sub-routine in the same program.

The fourth means of the system is a second computer 24 or solving means within the main computer 13 that takes the sorted data and computes the actual distances and flight times.

When a ball hits the ground, the sensors 10 in the immediate region of the impact sense the impact and generate a small voltage signal which is amplified by the associated amplifier 16 which then resets the associated flip/flop circuit 17. When a flip/flop circuit 17 is reset, the associated counter/timer 18 stops counting and retains its count in the associated hold register. The counter/timer associated with those sensors which do not sense the impact keep counting until reaching terminal count.

Each hold register 18' is now read by the computer 13 and its value stored in an array with its sensor identifier. For example, each sensor is numbered from 1 through 81. This array is then sorted by a sorting means to select the six shortest times. These times are then added to the 5 second base time to give six "raw" flight times. These six raw flight times are then sent to the solving means where, mathematically, the actual carry distance and differential from a zero yard center line and the corrected flight times are calculated.

After the data is sent to the solving means, a reset pulse is sent via the reset counter 22 to all the flip/flop circuits 17 to make sure that all of the circuits 17 are reset to await the next impact. The reset is necessary because of those sensors and associated amplifiers that do not sense the impact, the flip/flops are not reset by the ball impact.

Of note, the 5 second timer 19 is programmed to function in Mode C as a hardware triggered strobe. The value of 50000 (for 5 seconds) is loaded into a configured counter/timer 19 and the counter starts to count down when a start signal is received. When the counter completes the countdown, a negative pulse is generated by the timer 19 which activates all the sensor circuit flip/flop circuits 17 and the associated system timing controllers 18.

When the 5 second pulse is received, the flip/flop circuits 17 change state causing the gate of the associated counter/timer 18 to become positive and to allow counting of clock pulses. These counter/timers 18 continue to count until an associated flip/flop circuit 17 state changes as a result of a ball impact or until reaching a terminal count.

The reset counter 22 is programmed as a Mode A software triggered strobe. At a predetermined point in the program, this counter 22 is loaded and armed which causes a positive pulse to be generated. This pulse is used to reset all the flip/flop circuits 17 not already reset as a function of detecting a ball impact.

By way of example, the grid of sensors 10 is shown in numbered positions from 1 to 81. Thus, the location of the impact point of a ball can be determined electronically as being within a square defined by four sensors. As noted above, the computer 13 receives the signals of the sensors recording the six shortest times of impact. From this information, the point of impact can be determined to be within a given square of sensors.

That is to say, the solving means in the second computer 24 carries out a series of mathematical computations based upon the initial six shortest times of impact recorded in order to determine the square of four sensors within which the ball has landed. Thereafter, the solving means determines the point of impact within the square in which the ball has landed. These calculations are based upon the time of impact recorded for each sensor and the distances between the respective sensors of the square. Where the four recorded times of impact are exactly the same, the point of impact is mathematically determined to be at the center of the square, that is, at the point of intersection of the two diagonals of the square.

By way of example, the six shortest recorded times may be as follows:

| Sensor No. | Time |
|---|---|
| 43 | 0.8 seconds |
| 52 | 0.85 seconds |
| 42 | 0.87 seconds |
| 51 | 0.88 seconds |
| 44 | 1.05 seconds |
| 53 | 1.10 seconds |

From these calculations, the solving means is able to first determine that the square within which the ball impacted is defined by the four sensors 42, 43, 51, 52. Thereafter, knowing the distances between the four sensors and the time of impact, mathematical calculations are made to determine the actual point of contact within this square of sensors. A solution of the four non-linear equations is then carried out for the four unknowns which are the time of flight, the speed of sound in the ground and the two coordinates of the impact point relative to the closest sensor. The system of four equations is reduced to two equations by removing, by the method of substitution, the time of flight and the velocity of sound. The remaining two equations, for the relative coordinates, are solved numerically by a combination of Newton-Raphson iteration and fixed point procedures. After the relative coordinates are determined, the time of flight and the speed of sound are obtained by backward substitution.

Next, the solving means calculates the distance of the point of impact from the tee as the "carry" of the ball. In this respect, each row of sensors 10 corresponds to a given distance from the tee. For example, the first row may correspond to 260 yards, the second row to 265 yards, the third row to 270 yards, and so on.

The solving means is also able to calculate the flight time of the ball by taking into account the distance of the sensor recording the shortest time from the point of impact and the speed of sound through the ground.

Of note, the plotting of the flight path would be based on a "standard" flight path for a golf ball having a carry and flight time corresponding to the calculated values. The standard golf path is determined by calculating the lift and drag forces which are required to produce the calculated flight time and carry distance for the particular golf ball. From these forces, it is possible to predict the position of a golf ball in the air from tee to impact. These positions are applied on a graphical device, such as a computer monitor.

The equations which are used to determine the flight path are the standard differential equations for the flight of a spinning sphere in a resistive medium with a gravitational field. The solution of these equations is obtained numerically by using a Runge-Kutta 4th order iteration procedure.

The solving means may also determine a lateral deviation of the flight path from a straight line from the tee to the grid of sensors 10 as a measure of a hook or a slice of the ball. Thus, knowing the point of impact of the golf ball, a simple calculation can be made to determine the lateral deviation from the straight line running from the tee through the grid of sensors 10.

The system may also include recording means for recording other data such as wind condition, temperature conditions and the like. The recorded data may then be sent to the second computer 24 and separately recorded from the calculations for determining the flight time and the carry of the ball.

The invention thus provides a system for automatically determining the carry and/or lateral deviation and/or flight time of a golf ball and a system which is not affected by outside interference, such as noises. Further, this system is not affected by windy conditions as the sound of impact is transmitted through the ground to the sensors.

The invention further relies upon equations to solve for the point of impact which equations are independent of the soil characteristics.

The invention thus provides a system which is reliable, and which may be used in the dark, such as at night time or at night fall, since no visual observations are required.

The system also allows accurate flight times to be calculated without a need for visual observations or subjective judgement.

What is claimed is:

1. A system for determining at least one of the carry, lateral deviation and flight time of a driven golf ball comprising a grid of sensors, each sensor being buried at a predetermined point under a ground surface for sensing the impact of a golf ball on the ground surface via sound waves travelling through the ground and emitting a signal corresponding to said impact;

a mechanical means for stroking a golf ball from a predetermined point onto the ground surface within said grid of sensors;

signal means associated with said mechanical means for emitting a start pulse indicative of the time at which a golf ball leaves said predetermined point;

a plurality of circuit boards, each board being connected with a respective sensor to receive a signal therefrom corresponding to the sensed impact of a golf ball, each board having an amplifier to amplify a received signal and a flip/flop circuit for changing from an activated state to a dormant state in response to said amplified signal;

a plurality of counter/timers, each counter/timer being connected with a respective flip/flop circuit to conduct a counting sequence with said flip/flop circuit in said activated state and to subsequently stop said counting sequence in response to said flip/flop circuit switching to said dormant state, each counter/timer having a hold register to retain said counting sequence in response to switching of said flip/flop circuit to said dormant state;

a timer for receiving said start pulse from said signal means and connected to each flip/flop circuit to deliver a pulse thereto after expiration of a base time in response to said start pulse to switch each said flip/flop circuit to said activated state thereof;

a computer having store means for reading and storing a value corresponding to a retained counting sequence in each hold register and a corresponding sensor identifier and sorting means for sorting said stored values and selecting a preselected number of the shortest time values and corresponding sensor identifiers for addition to said base time as recorded times of impact; and solving means for receiving the recorded times of impact from said sorting means and calculating the point of impact of the golf ball within said grid in dependence on said recorded times of impact and the distances between said sensors as a measure of the carry of the golf ball.

2. A system as set forth in claim 1 wherein said solving means determines the point of impact of a golf ball in dependence on the locations of the sensors corresponding to the six shortest times of impact and the times of impact corresponding thereto.

3. A system as set forth in claim 1 wherein said base time is 5 seconds.

4. A system as set forth in claim 1 which further comprises a program means for calculating the flight time of the golf ball from said predetermined point to said point of impact and for plotting and displaying a flight path of the golf ball based on the calculated carry of the golf ball and the calculated flight time.

5. A system as set forth in claim 4 wherein said program means determines a lateral deviation of the flight of the golf ball from a straight line from said mechanical means as a measure of one of a hook and a slice of the golf ball.

6. A system for determining at least one of the carry, lateral deviation and flight time of a driven golf ball comprising a grid of sensors, each sensor being buried at a predetermined point under a ground surface for sensing the impact of a golf ball on the ground surface via sound waves travelling through the ground and emitting a signal corresponding to said impact;

signal means for emitting a start pulse indicative of the time at which a golf ball leaves a predetermined point;

a plurality of circuit boards, each board being connected with a respective sensor to receive a signal therefrom corresponding to the sensed impact of a golf ball, each board having an amplifier to amplify a received signal and a flip/flop circuit for changing from an activated state to a dormant state in response to said amplified signal;

a plurality of counter/timers, each counter/timer being connected with a respective flip/flop circuit to conduct a counting sequence with said flip/flop circuit in said activated state and to subsequently stop said counting sequence in response to said flip/flop circuit switching to said dormant state, each system timing controller having a hold register to retain said counting sequence in response to switching of said flip/flop circuit to said dormant state;

a timer for receiving said start pulse from said signal means and connected to each flip/flop circuit to deliver a pulse thereto after expiration of a base time in response to said start pulse to switch each said flip/flop circuit to said activated state thereof;

a computer having store means for reading and storing a value corresponding to a retained counting sequence in each hold register and a corresponding sensor identifier and sorting means for sorting said stored values and selecting a preselected number of the shortest time values and corresponding sensor identifiers as recorded times of impact; and solving means for receiving the recorded times of impact from said sorting means and calculating the point of impact of the golf ball within said grid in dependence on said recorded times of impact and the distances between said sensors as a measure of the carry of the golf ball.

7. A system as set forth in claim 6 wherein said solving means determines the point of impact of a golf ball in dependence on the locations of the sensors corresponding to the six shortest times of impact and the times of impact corresponding thereto.

8. A system as set forth in claim 6 which further comprises a second computer having said solving means therein.

9. A system as set forth in claim 6 where said sensors are disposed in a square grid.

10. A system as set forth in claim 6 which further comprises a program means for calculating the flight time of the golf ball from said predetermined point to said point of impact and for plotting and displaying a flight path of the golf ball based on the calculated carry of the golf ball and the calculated flight time.

11. A system as set forth in claim 10 wherein said program means determines a lateral deviation of the flight of the golf ball from a straight line from said point to said grid of sensors as a measure of one of a hook and a slice of the golf ball.

12. A system as set forth in claim 6 which further comprises a reset counter connected to said flip/flop circuits to deliver a reset pulse to each said circuit to return each said circuit to said dormant state thereof.

13. A system as set forth in claim 6 which further comprises an outdoor enclosure near said grid of sensors and housing said circuit boards, said counter/timers and said computer therein.

14. A system as set forth in claim 13 wherein said solving means is disposed in a second computer remote from said enclosure.

* * * * *

UNITED STATES PATENT AND TRADEMARK OFFICE

CERTIFICATE OF CORRECTION

PATENT NO. : 5,562,285

DATED : October 8, 1996

INVENTOR(S) : Leonard F. Anfinsen

It is certified that error appears in the above-indentified patent and that said Letters Patent is hereby corrected as shown below:

Column 4, Line 37 change "1/8" to -1/8"-

Signed and Sealed this

Seventeenth Day of December, 1996

*Attest:*

Bruce Lehman

BRUCE LEHMAN

*Attesting Officer*

*Commissioner of Patents and Trademarks*